US005852802A

United States Patent [19]

Breen et al.

[11] Patent Number: 5,852,802

[45] Date of Patent: Dec. 22, 1998

[54] SPEED ENGINE FOR ANALYZING SYMBOLIC TEXT AND PRODUCING THE SPEECH EQUIVALENT THEREOF

[75] Inventors: Andrew P. Breen; Andrew Lowry; Margaret Gaved, all of Ipswich, England

[73] Assignee: British Telecommunications Public Limited Company, London, England

[21] Appl. No.: 847,246

[22] Filed: May 1, 1997

Related U.S. Application Data

[63] Continuation of Ser. No. 272,533, Jul. 11, 1994, abandoned.

[30] Foreign Application Priority Data

May 23, 1994 [EP] European Pat. Off. ..... 94303675.6

[51] Int. Cl.[6] ..... G10L 5/00

[52] U.S. Cl. ..... 704/260; 704/272

[58] Field of Search ..... 395/2.69, 2.81; 704/260, 272, 275, 270, 1, 9

[56] References Cited

U.S. PATENT DOCUMENTS

| | | | |
|---|---|---|---|
| 4,773,009 | 9/1988 | Kucera et al. | 364/419.1 |
| 4,811,400 | 3/1989 | Fisher | 381/44 |
| 4,864,501 | 9/1989 | Kucera et al. | 364/419.1 |
| 5,146,406 | 9/1992 | Jensen | 364/419 |
| 5,278,943 | 1/1994 | Gasper et al. | 395/2 |
| 5,323,316 | 6/1994 | Kadashevich et al. | 364/419.01 |
| 5,475,587 | 12/1995 | Anick et al. | 363/419.08 |

FOREIGN PATENT DOCUMENTS

| | | | |
|---|---|---|---|
| WO89/03573 | 4/1989 | WIPO | G10L 5/04 |
| WO93/04465 | 3/1993 | WIPO | G10L 5/00 |
| WO 94/23423 | 10/1994 | WIPO | G10L 5/04 |

*Primary Examiner*—Richemond Dorvil
*Attorney, Agent, or Firm*—Nixon & Vanderhye, P.C.

[57] ABSTRACT

A speech engine for producing synthetic speech from an input in convention orthography. The speech engine analyses the input data into small elements which are used to produce the synthetic speech. The analysis is carried out with the aid of a skeletal database 11 and a plurality of symbolic processor 12–16 each of which is adapted to preform one linguistic task. Each processor 13–16 obtains its data from the database 11 (processor 12 obtains its data from an input buffer 10). Each processor returns its results to the database 11. The database 11 is organised in accordance with the linguistic structures so that the results and intermediate results are not only stored but the linguistic relationships are also available. Preferably the database 11 is formed of a plurality of storage modules (1/1–5/7) each of which has an address. Each module has a register 100 which holds an item of data being either an intermediary or final result. In addition each module contains addresses of related modules 101, 102, 103 whereby the linguistic structure of the sentence is defined.

13 Claims, 3 Drawing Sheets

Fig.3A.

LEVEL 1

| | 1/1 | | |
|---|---|---|---|
| 100 | BOOKS | ARE | PRINTED |
| 101 | | 2/1 | |
| 102 | | 2/3 | |
| 103 | | 00/00 | |

Fig.3B.

LEVEL 2

| | 2/1 | 2/2 | 2/3 |
|---|---|---|---|
| 100 | BOOKS | ARE | PRINTED |
| 101 | 3/1 | 3/2 | 3/3 |
| 102 | 3/1 | 3/2 | 3/4 |
| 103 | 1/1 | 1/1 | 1/1 |

Fig.3C.

LEVEL 3

| | 3/1 | 3/2 | 3/3 | 3/4 |
|---|---|---|---|---|
| 100 | BOOKS | ARE | PRIN | TED |
| 101 | 4/1 | 4/3 | 4/4 | 4/6 |
| 102 | 4/2 | 4/3 | 4/5 | 4/7 |
| 103 | 2/1 | 2/2 | 2/3 | 2/3 |

Fig.3D.

LEVEL 4

| | 4/1 | 4/2 | 4/3 | 4/4 | 4/5 | 4/6 | 4/7 |
|---|---|---|---|---|---|---|---|
| 100 | B | OOKS | ARE | PR | IN | T | ED |
| 101 | 5/1 | 5/2 | 5/3 | 5/4 | 5/5 | 5/6 | 5/7 |
| 102 | 5/1 | 5/2 | 5/3 | 5/4 | 5/6 | 5/6 | 5/7 |
| 103 | 3/1 | 3/1 | 3/2 | 3/3 | 3/3 | 3/4 | 3/4 |

Fig.3E.

LEVEL 5

| | 5/1 | 5/2 | 5/3 | 5/4 | 5/5 | 5/6 | 5/7 |
|---|---|---|---|---|---|---|---|
| 100 | b | ooks | are | pr | in | t | ed |
| 101 | 00/00 | 00/00 | 00/00 | 00/00 | 00/00 | 00/00 | 00/00 |
| 102 | 00/00 | 00/00 | 00/00 | 00/00 | 00/00 | 00/00 | 00/00 |
| 103 | 4/1 | 4/2 | 4/3 | 4/4 | 4/5 | 4/6 | 4/7 |

SPEED ENGINE FOR ANALYZING SYMBOLIC TEXT AND PRODUCING THE SPEECH EQUIVALENT THEREOF

This is a continuation of application Ser. No. 08/272,533, filed Jul. 11, 1994, now abandoned.

FIELD OF THE INVENTION

This invention relates to a speech engine, i.e. to equipment which synthesises speech from substantially conventional texts.

BACKGROUND OF THE INVENTION

There is a requirement for "reading" a text in machine accessible format into an audio channel such as a telephone network. Examples of texts in machine accessible format include wordprocessor discs and text contained in other forms of computer storage. The text may be constituted as a catalogue or directory, e.g. a telephone directory, or it may be a database from which information is selected.

Thus, there in an increasing requirement to obtain remote access, e.g. by telephone lines, to a stored text with a view to receiving retrieved information in the form of intelligible speech which has been synthesised from the original text. It is desirable that the text which constitutes the primary input shall be in conventional orthography and that the synthetic speech shall sound natural.

The input is provided in the form of a digital signal which represents the characters of conventional orthography. For the purposes of this specification the primary output is also a digital signal representing a acoustic waveform corresponding to the synthetic speech. Digital-to-analogue conversion is a well established technique to produce analogue signals which can drive loud speakers. The digital-to-analogue conversion may be carried out before or after transmission through a telephone network.

The signal may have any convenient implementation, e.g. electrical, magnetic, electromagnetic or optical.

The speech engine converts a signal representing text, e.g. a text in conventional orthography, into a digital waveform which represents the synthetic speech. The speech engine usually comprises two major sub-units namely an analyser and a synthesizer. The analyser divides the original input signal into small textual elements. The synthesizer converts each of these small elements into a short segment of digital waveform and it also joins these together to produce the output. This invention relates particularly to the analyser of a speech engine.

It will be appreciated that the linguistic analysis of a sentence is exceedingly complicated since it involves many different linguistic tasks. All the various tasks have received a substantial amount of attention and, in consequence, there are available a wide variety of linguistic processors each of which is capable of doing one of the tasks. Since the linguistic processors handle signals which represent symbolic text it is convenient to designate them as "symbolic processors".

It is emphasised that there is a wide variety of symbolic processors and it is convenient to identify some of these types. A particularly important category can be designated as "analytic devices" because the processor functions to divide a portion of text into even smaller portions. Examples of this category include the division of sentences into words, the division of words into syllables and the division of syllables into onsets and rimes. Clearly, a sequence of such analytic devices will eventually break up a sentence into small linguistic elements which are suitable for input to a synthesizer. Another important category can be designated as "converters" in that they change the nature of the symbols utilised. For example a "converter" will alter a signal representing a word or other linguistic element in graphemes into a signal representing the same element in phomenes. Grapheme to phoneme conversion often constitutes an important step in the analysis of a sentence. Further examples of symbolic processors include systems which provide pitch or timing information (including pauses and the duration thereof). Clearly, such information will enhance the quality of synthetic speech but it needs to be derived from a symbolic text and, symbolic processors are available to performs these functions.

It is emphasised that, although individual symbolic processors are available, the actual performance of an analysis requires several different processors which need to cooperate with one another. It, as is usual, the individual processors have been developed individually they may not adopt common linguistic standards and it is, therefore, difficult to achieve adequate cooperation. This invention is particularly concerned with the problem of using incompatible processors.

SUMMARY OF INVENTION

This invention addresses the problem of incompatibility in the symbolic processors by arranging that they do not cooperate directly with one another but via a database. For reasons which will be explained in greater detail below this database can be designated as "skeletal" database because its structure is important while it may have no permanent content. The effect of the database is to impose a common format on the data contained therein whereby incompatible symbolic processors are enabled to communicate. Conveniently a sequencer enables the symbolic processors in the order needed to produce the required conversion.

This invention, which is defined in the claims, includes the following categories:

(i) analysers which comprise the database and a plurality of symbolic processors operatively connected to the database for exchange of information between the symbolic processors, (ii) speech engines which comprise an analyser as mentioned in (i) together with a synthesizer which produces synthetic speech from the results produced by (i), (iii) a method of analysing signals representing text in symbolic form wherein the analysis is achieved in a plurality of independent stages which communicate with one another via a database, and (iv) a method of generating synthetic speech which involves carrying out a method as indicated in (iii) and generating a digital waveform from the results of that analysis.

An analyser in accordance with the invention preferably includes an input buffer for facilitating transfer of primary data from an external device, e.g. a text reader, into the analyser.

The database can be designated as a "skeletal" database because it has no permanent content. The text is processed batch wise, e.g. sentence by sentence, and at the start of the processing of each batch the skeletal database is empty and the content is generated as the analysis proceeds. At the end of the processing of each batch the skeletal database contains the results of the linguistic analysis, and this includes the data needed by the synthesizer. When this data has been provided to the synthesizer, the skeletal database is cleared so that it is, once again, empty to begin processing the next batch. (Where the speech engine includes an input buffer, the input buffer will normally retain data when the database is cleared at the end of each batch of processing.)

In addition to the skeletal database, the analyser may contain one or more substantive databases. For example a linguistic processor may include a database.

The skeletal database is preferably organised into "levels" wherein each "level" corresponds to a specific stage in the analysis of a batch, e.g. the analysis of a sentence. The following is an example of five such levels.

LEVEL ONE

This represents a "batch" for processing, e.g. a complete sentence. In preferred embodiments only one batch (sentence) at a time is processed and LEVEL ONE does not contain more than one batch.

LEVEL TWO

This represents the analysis of a sentence (LEVEL ONE) into words.

LEVEL THREE

This represents the analysis of a word (LEVEL TWO) into syllables.

LEVEL FOUR

This represents the division of a syllable (LEVEL THREE) into an onset and a rime.

LEVEL FIVE

This represents the conversion of onsets and rimes (LEVEL FOUR) into a phonetic text.

It must be emphasised that most analysers in accordance with the invention will operate with more than five levels, but the five levels just identified are particularly important and they will usually be included in more complicated speech engines.

It is also preferred that the database is organised into a plurality of addressable storage modules each of which contains prearranged storage registers. It is emphasised that the address of the module effectively identifies all the storage registers included within the module.

Each module contains one or more registers for containing linguistic information and one or more registers for containing relational information. The most important register is adapted to contain the linguistic information which, in general, has been obtained by previous analysis and which will be used for subsequent analysis. Other linguistic registers may contain information related to the information in the main register. Examples of associated information include, in the case of words, grammatical information such as parts of speech or function in the sentence or, in the case of syllables, information about pitch or timing. Such subsidiary information may be needed in subsequent analysis or synthesis.

The relational registers contain information which specifies the relationship between the module in which the register is contained and other modules. These relationships will be further explained.

It has already been stated that the skeletal register is organised into "levels" and the modules of the skeletal database are therefore organised into these levels. The address of the module is conveniently made of two parameters wherein the first parameter identifies the level and the second parameter identifies the place of the module within its level. In this specification the symbol "N/M" will be used wherein "N" represents the level and "M" represents the location within the level. It will be appreciated that this technique of addressing begins to impose relationships between the modules.

It is now convenient to identify four important relationships which, in general, apply to each module. These four relationships will be identified as:

"up-next"

"down-next"

"left-next"

"right-next"

The meaning of each of these relationships will now be further explained.

Up-next

As stated each module has a register which contains textual data. With the possible exception of the first module, the linguistic data will have been derived from the existing data contained in other modules. Usually the data will have been derived from one other module. The register "up-next" contains the address of the module from which it was derived. Preferably the database is organised so that a module is always derived from one in the next lower level. Thus a module in level (N+1) will be derived from a module in level N.

Down-next

The down-next relationship is the inverse of the up-next relationship just specified. Thus if the module with address N/M contains the address X/Y in its up-next register, then the module with the address X/Y will contain the address N/M in its down-next register. It should be noted that most linguistic elements have several successors and only one predecessor. It is, therefore, usually necessary to provide arrangements for a plurality of down-next registers whereas one up-next register may suffice.

Left-next and right-next

It has been stated that each module has a main substantive register which contains an element of linguistic information relating to a portion of the batch being processed. Thus the modules in any one level are inherently ordered in the order of the sentence. It is usually convenient to ensure that the modules are processed in this sequence so that new modules are created in this sequence. Therefore the address within a level, the parameter "M" as defined above defines the sequence. Thus the module having address N/M will have as its left-next and right-next modules those with the addresses N/(M−1) and N/(M+1).

It will be appreciated that this method of defining left-next and right-next assumes that the modules are created in strict sequential order and it is usually convenient to design an analyser so that it operates in this way. If any other mode of operation is contemplated then it is necessary to supply, in each module, two registers. One to contain the address of left-next and the other to contain the address of right-next. It will be appreciated that the relationships left-next and right-next are unique.

It will be understood that there are "beginnings" and "endings" of sequences which do not display all the relationships. Clearly, there must be a first module which is derived directly from the input buffer and this module will have no up-next module; if desired the input buffer can be regarded as the up-next relation. At the other end of the sequence there will be many modules which contain the end result of the analysis and these modules will, therefore, have no down-next module. Similarly, a module representing the beginning of a sentence will have no left-next relation and that at the end of the sentence will have no right-next relation. It is usually convenient to provide an end (or beginning) code in the appropriate relational register for such modules.

The structure of the (skeletal) database according to the invention has now been described and it will be appreciated that the analysis, carried out by the symbolic processors in specified sequence, is performed module to module. That is, each symbolic processor is provided with its data from the database by selection of the required module. The processor therefore has only to process that information. It can, therefore, work independently and this substantially improves flexibility of operation and, in particular, it facilitates modification to meet different requirements for the analysis for different texts.

BRIEF DESCRIPTION OF THE DRAWINGS

The invention will now be described by way of example with reference to the accompanying drawings in which:

FIGS. 3A to 3E illustrate the content of the database after processing a simple sentence, namely "Books are printed."

DETAILED DESCRIPTION OF THE DRAWINGS

Figure 1:
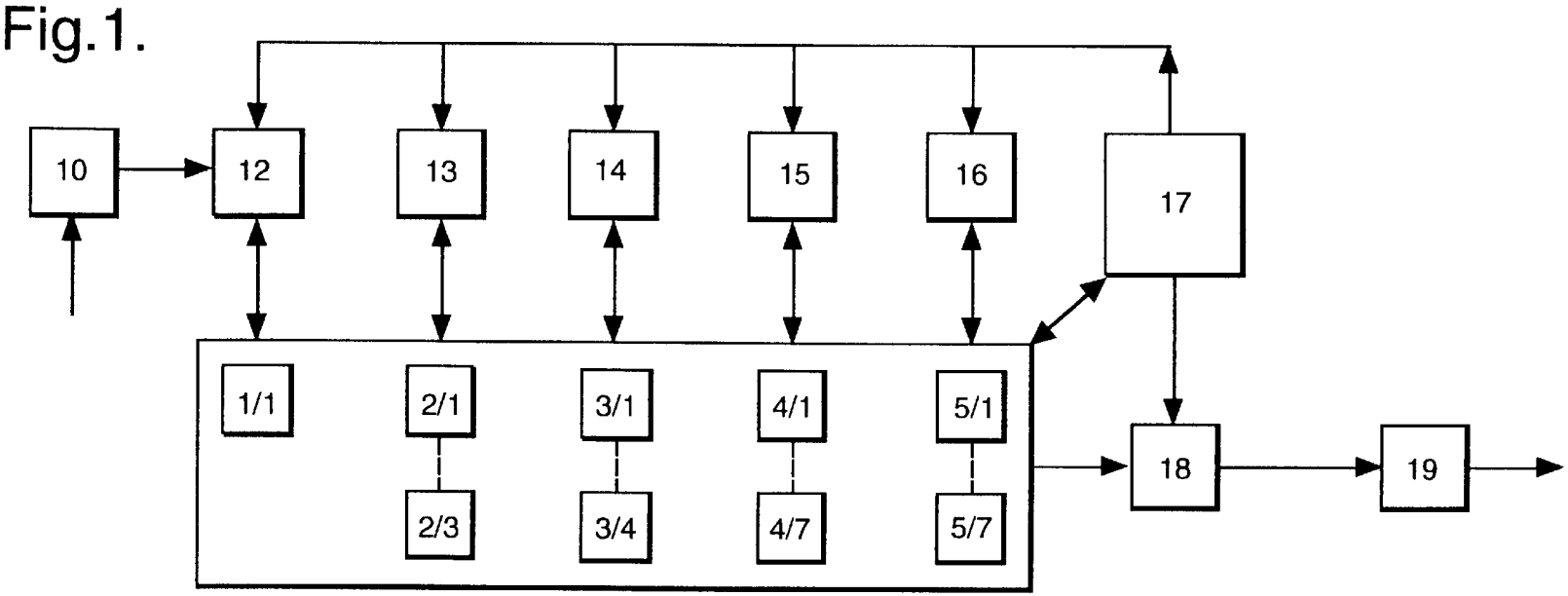
FIG. 1 is a diagrammatic representation of a speech engine in accordance with the invention.

FIG. 1 shows, in diagrammatic form a (simplified) speech engine in accordance with the invention. The purpose of the speech engine is to receive a primary input signal representing a text in conventional orthography and produce therefrom a final output signal being a digital representation of an acoustic waveform which is the speech equivalent of the input signal.

The input signal is provided to the speech engine from an external source, eg a text reader, not shown in any drawing.

The output signal is usually provided from the speech engine to a transmission channel, eg a telephone network, not shown in any drawing. The digital output is converted into an analogue signal either before or after transmission. The analogue signal is used to drive a loud speaker (or other similar device) so that the ultimate result is speech in the form of an audible acoustic waveform.

As usual in synthetic speech devices the input signal, ie conventional orthography, is analysed into elemental signals and the digital output is synthesised from these signals. The synthesis may utilise one or more permanent two-part databases which are not specifically shown in any drawing. The access side of a two-part database is accessed by the elements (as phonemes) and this provides an output which is an element of the digital waveform. These short waveforms are joined together, eg by concatenation, to create the digital output.

The speech engine shown in FIG. 1 comprises an input buffer 10 which is adapted for connection to the external source so that the speech engine is able to receive the input signal. Since buffers are commonplace in computer technology this arrangement will not be further described.

The analyser of the speech engine comprises a skeletal database 11, five symbolic processors 12, 13, 14, 15 and 16 and a sequencer 17. Symbolic processor 12 is connected to receive its data from the input buffer 10 and to provide its output to the database 11 for storage. Each of the other processors ie 13–16, is connected to receive its data from the database 11 and to return its results back to the database 11 for storage.

The processors 12–16 are not directly interconnected with one another since they only co-operate via the database 11. Although each processor is capable of co-operating with the database 11 there is no need for them to be based on consistent linguistic theories and there is no need for them to have identical definitions of linguistic elements.

The sequencer 17 actuates each of the processors in turn and thereby it specifies and controls the sequence of operations. When the last processor (ie 16 in FIG. 1) has operated the analysis is complete and the database 11 contains not only the end result of the analysis but all of the intermediate steps. The completion of the analysis implies that the database 11 contains all the data needed for the synthesis of the digital output.

The synthesis is carried out in a synthesizer 18 which is connected to the database 11 so as to receive its input. The digital waveform produced by the synthesizer 18 is passed to an output buffer for intermediate storage. The output buffer 19 is adapted for connection to a transmission channel (not shown) and, as is usual for output buffers, it provides the digital signal to suit the requirements of this channel. It can be regarded as the task of the speech engine to convert an input signal located in input buffer 10 into an output signal located in output buffer 19.

It is emphasised that the skeletal database 11 has no permanent content, ie it is emptied after each batch has been processed. As the analysis proceeds more and more intermediate results are produced and these are all stored in the database 11 until the final results of the analysis are also stored in the database 11. The skeletal database 11 is structured in accordance with the linguistic structure of a sentence and, therefore, the intermediate and final results stored therein have this structure imposed upon them. The structure of the database is, therefore, an important aspect of the invention and this structure will now be more fully described.

According to a preferred aspect of the invention the skeletal database 11 comprises a plurality of modules each of which comprises a plurality of registers. Each module has an address and the address accesses all of the storage registers of the module. The address comprises two parameters "N" and "M". "N" denotes the level of the modules and "M" denotes the place in the sequence within the level. In FIG. 1 it is indicated that the database comprises twenty-two modules (but not all of these are shown to avoid crowding the drawing). The number "twenty-two" is arbitrary and it was chosen to illustrate the analysis of the sentence "Books are printed."

As shown in FIG. 1, the modules are organised in five levels and Table 1 shows the number in each level.

TABLE 1

| LEVEL | 1 | 2 | 3 | 4 | 5 |
|---|---|---|---|---|---|
| NUMBER | 1 | 3 | 4 | 7 | 7 |

Figure 2:
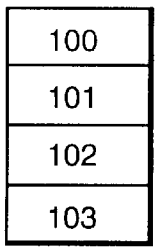
FIG. 2 illustrates the structure of the storage modules contained in the skeletal database of the speech engine illustrated in FIG. 1.

Each module has the same structure and FIG. 2 illustrates this structure diagrammatically. As shown in FIG. 2 each module comprises four registers as follows.

Register 100

Contains "data" and this data will have been produced by one of the processors 12, 13, 14, 15 or 16. Register 100 will also be used to provide input to another of the processors 13–16 or to the synthesizer 18. In preferred embodiments (not shown) there are further registers for containing different types of data, e.g. pitch information and timing information. In modifications (not shown) the modules have different sizes at different levels.

Registers 101 and 102

Contain the address of another module (or the address of two modules) to define the relationship described as "down-next" above. During the course of the analysis the data in Register 100 will be further analysed and one or more derivatives will be produced therefrom. These derivatives will be returned to the database 11 and stored in new modules. Registers 101 and 102 contain the addresses needed to identify these modules. In general, there will be a plurality of derivatives and, therefore, a plurality of modules must be identified. These will run in sequence and, for convenience of illustration, the address of the first of these is given in register 101 and the last is given in register 102. In the special case (where there is only one derivative) registers 101 and 102 will contain the same address.

Register 103

Contains the address of the module identified above by the relationship "up-next". It will be appreciated that this is the reciprocal relationship of the "down-next" relationship used in registers 101 and 102. In all modules except 1/1, the information in register 100 will have been derived from another module located in database 11. The address of this module is contained in register 103. This module is unique and, therefore, only one register is needed.

The relationships just explained can also be identified using the words "parent" and "child". As the analysis proceeds more and more the intermediate results are produced and each derivative can be described as the "child" of a "parent". Since a "parent" may have a plurality of "children" registers 101 and 102 identify the addresses of all the children of the item in register 100. Similarly, register 103 contains the address of the "parent" and only one address is needed because the "parent" is unique. It will be appreciated that, taking all the modules together, the complete descent of all items is given by registers 101, 102 and 103.

It has also been explained that the modules are located in sequences which correspond to the ordering of sentence under analysis. In the description given above these relationships are described as "left-next" and "right-next". These relationship are contained in the addresses of modules. Thus, if module 4/3 is considered then "left-next" is 4/2 and "right-next" is 4/4.

We have now described the structure of the database and FIGS. 3A to 3E show the content and organisation of the database when the sentence "Books are printed." has been analysed. For convenience of display, FIG. 3 is divided into five "levels" each of which is organised in the same way. Levels 1–3 are contained in FIGS. 3A to 3E whereas levels 4 and 5 are contained in FIGS. 3D and 3E. Each level (except level 1) comprises a plurality of columns each containing four items. Each column represents a module and the four items represent the content of each of its four registers. Each level has a left hand column containing the numbers 100, 101, 102 and 103 which identifies the four registers as described above. Each column has a heading which represents the address of the module. Thus FIG. 3 provides the address and content of the twenty-two modules needed to analyse the sentence.

As shown in FIG. 3A, level one contains the whole sentence for analysis, level two shows the sentence divided into words, level three shows the words divided into syllables, level four of FIG. 3D shows the syllables divided into onsets and rimes and level five indicates the conversion of these into phonemes; the change from block capitals to lowercase is intended to indicate this change.

The structure of the database 11 has been explained but the relationships can be further identified by considering module 3/3 as defined in FIG. 3. Register 100 contains the data "PRIN" and this can be recognised as a syllable because it is in level 3. Reference to register 103 shows that "up-next" is module 2/3 and register 100 of module 2/3 contains the word "PRINTED" so that the syllable "PRIN" is identified as part of the this word. A further reference to "up-next" gives access module 1/1 which contains the sentence "Books are printed." Module 3/3 also contains addresses 4/4 and 4/5 in registers 101 and 102 and these two modules identify the onset "PR" and the rime "IN". Further reference to "down-next" converts the onset and the rime into phonemes.

It will also be apparent that, at every level, the second parameter of the address places the modules in order and this order corresponds to that of the original sentence. It can therefore be seen that the completed database 11 contains a full analysis of the sentence "Books are printed." and this full analysis displays all the relationships of all the linguistic elements in the sentence. It is an important feature of the invention that the database 11 contains all of this information. It should be emphasised that the database 11 does no linguistic processing. The analysis is done entirely by the symbolic processors which request, and get, data from the database. A processor only needs to work with the data in register 100.

The invention will be further described by explaining how the analyser of the speech engine produces the database content shown in FIGS. 3A to 3E.

At the start of the process the database is empty but raw, unprocessed data is available in the input buffer 10. Sequencer 17 initiates the analysis by activating processor 12 and instructing the database 11 to provide new storage at level 1. Processor 12 is adapted to recognise a sentence from crude data and, on receiving a stream of data from the input buffer 10 it recognises the sentence "Books are printed." and passes it to the database 11 for storage. Database 11 has been instructed to store at level 1 and therefore it creates module 1/1 and places the sentence "Books are printed." in register 100 of module 1/1. Database 11 also provides the code 00/00 in register 103 to indicate that there is no predecessor within the database. (Clearly there must be a first item which has no predecessor.) Processor 12 is special in that it does not receive its data from the database 11; as explained previously processor 12 receives it data from the input buffer 10. Processor 12 is also special in that it only ever has one output and, therefore, the passing of this single output to the database 11 marks the end of the first stage. This is notified to the sequencer 17 which moves on to the second stage.

In the second stage the sequencer 17 activates processor 13 (which is adapted to select words from a "sentence"). Sequencer 17 also instructs database 11 to provide data from level one and to store new data in level two. Storage of data requires the setting up of a new module to receive the new data.

On activation, processor 13 requests database 11 for data and in consequence it receives the content of module 1/1 (which includes register 100) and processor 13 analyses this content into "words". It returns to database 11, in sequence, the words "books", "are", "printed". Thus the database 11 receives three items of data and it stores them at level two. That is the database 11 creates the sequence of modules 2/1, 2/2 and 2/3. These modules are shown in FIG. 3. At the same time registers 101 and 102 of module 1/1 are completed. In addition the three registers 103 of the second level modules are also completed.

When processor 13 has completed the analysis of module 1/1 it requests more data from the database 11. However the database is constrained to supply data from level one and the whole of this level, i.e. module 1/1, has been utilised. Therefore, the database 11 sends an "out of data" signal to sequencer 17 and, in consequence, the sequencer 17 initiates the next task.

This time sequencer 17 actuates processor 14 (which is adapted to split words into syllables). Sequencer 17 also arranges that, when asked, the database 11 will provide data from level two and to create new modules for the storage of new data in level three. Processor 14 makes a first request for data and it receives module 2/1 which is analysed as being a single syllable. Therefore, only one output is returned and module 3/1 is created. Module 14 now asks for more data and it receives module 2/2 from which a single syllable is returned to provide module 3/2. On asking for yet more data processor 14 receives module 3/4 which is split into two syllables "PRIN" and "TED". These are returned to the database and set up as modules 3/3 and 3/4. Module 14 makes another request for data but, all modules at level 3 having being used, the database provides a signal indicating "no more data" to sequencer 17.

Sequencer 17 now actuates processor 15 to receive data from level 3 and provide new storage in level 4. Finally, sequencer 17 arranges for processor 16 to provide phonemes in level 5 from onsets and rimes in level 4. This completes the analysis.

When module 4/7 has been processed, the sequencer 17 is notified that analysis of level 4 is complete. Sequencer 17 recognises that this completes the analysis and it instructs the database 11 to provide the contents of modules 5/1 to 5/7 to the synthesizer 18. When this has been completed the processing of the batch is finished and sequencer 17 clears the database 11 in preparation for the processing of the next sentence. This repeats the sequence of operations just described but with new data.

In the description given above it is stated that when database runs out of data the processor informs the sequencer 17 which then initiates the next task. As an alternative, the database 11 informs the currently operational symbolic processor when it has run out of data. This enables the symbolic processor to decide that it has finished its operation and it is the symbolic processor which informs the sequencer 17 that it has been finished.

In the description given above it will be apparent each of the symbolic processors 12–16 forms one stage in the analysis and that, collectively, the five symbolic processors carry out the whole of the analysis. It will also apparent the each symbolic processor in turn continues the analysis by further processing the results of its predecessors. However there is no direct intercommunication between the symbolic processors and all information is exchanged via the database 11. This has the effect that a common structure is imposed upon all the results and the various symbolic processors do not need to have consistent or uniform linguistic definitions.

It can be seen that this arrangement provides for flexible working of the analyser of a speech engine and modification, eg by including more (or less) levels and by adding (or subtracting) processors, is facilitated. It will be appreciated that using more processors would make the description more complicated and extensive but the basic principle is not affected. It will also be apparent that there are a wide variety of known symbolic processors and a database in accordance with invention facilities their coordination for the processing of more complicated sentences. In addition the arrangement facilitates modifying the analyser to process different languages.

We claim:

1. A linguistic analyser adapted to receive an input signal representing a symbolic text and to analyse said input signal into a plurality of elemental signals each of which represents a linguistic element of said input text, wherein said linguistic analyser comprises:

(a) a plurality of symbolic processors for processing the input signal and generating intermediate signals;

(b) a skeletal database for storing intermediate signals relating to the analysis;

(c) a plurality of the symbolic processors operatively connected to the skeletal database so that each of said processors is enabled to receive input from said skeletal database and to return its output to said skeletal database, wherein the skeletal database has a structure which includes storage locations of said intermediate signals, said storage locations being organised so that the linguistic relationships between the signals stored therein are defined.

2. An analyser according to claim 1, which also includes a sequencer for enabling the symbolic processors in the order needed the achieve the analysis.

3. An analyser according to claim 1, wherein the skeletal database is organised as a plurality of addressable modules wherein each module contains a plurality of storage registers, said registers including at least one register for containing one of said intermediate signals and at least one register for containing an address identifying a related module.

4. An analyser according to claim 3, wherein each module except the first contains one register for containing the address of its precursor module.

5. An analyser according to claim 3, wherein each module except a final module includes one or more registers the or each of which is adapted to contain the address of a successor module.

6. An analyser according to claim 3, wherein the skeletal database is organised into levels wherein the modules contained in any level except the first are derived from modules contained in the previous level and the modules within the any one of level are arranged in a sequence according to the original data.

7. A speech engine which includes an analyser according to claim 1 and a synthesizer which is operationally connected to the skeletal database so that the synthesizer is enabled to receive said elemental signals and convert them into a digital waveform equivalent to speech corresponding to the original input text.

8. A telecommunications system which includes a speech engine according to claim 7, a transmission system for transmitting digital or analogue signal to a distant location and means for presenting the digital waveform produced by said speech engine as an audible acoustic waveform at said distant location, wherein the means for converting the digital waveform into the acoustic waveform is located either at the input end of the transmission system, at the output end of the transmission system, or within the transmission system.

9. A method of analysing an input signal representing symbolic input text into elemental signals representing linguistic elements of said input text, said method comprising:

a) carrying out an analysis of the input signal in a series of steps carried out in a plurality of independent symbolic processors utilizing a skeletal database for storing not only said intermediate signals, but also relationships between the stored intermediate signals;

b) said series of steps providing intermediate signals to the skeletal database for storage; and c) said series of steps, except the first, utilizing said intermediate signals produced by previous steps carried out in said independent symbolic processors and stored in said skeletal database;

whereby the transferring of intermediate signals from an earlier step carried out in an independent symbolic processor to a later step carried out in an independent symbolic processor is carried out by said earlier step storing said signals in said skeletal database and said later step retrieving said signals from said skeletal database.

10. A method according to claim 9, wherein for each intermediate signal, the skeletal database stores its descent and its location in a sequence corresponding to the original symbolic input text.

11. A method of generating a digital waveform representing synthetic speech corresponding to an input signal representing a symbolic input text which method comprises analysing the input signal into elemental signals and storing said elemental signals in the skeletal database by a method according to claim 9 and said digital waveform is generated from said elemental elements stored in said skeletal database.

12. A method of generating audible synthetic speech which comprises converting the digital waveform of claim 11 into an audible output.

13. A method according to claim 12 wherein the synthetic speech is transmitted to a distant location the conversion from the digital waveform being performed either before or after said transmission.

* * * * *